US005992892A

United States Patent [19]

Schaefer et al.

[11] Patent Number: 5,992,892

[45] Date of Patent: Nov. 30, 1999

[54] BEVERAGE CAN HAVING INSTANT WINNER TYPE GAME THEREON

[75] Inventors: Mark W. Schaefer, Knoxville, Tenn.; Thomas L. Levendusky, Greensburg, Pa.

[73] Assignee: Aluminum Company of America, Pittsburgh, Pa.

[21] Appl. No.: 08/991,791

[22] Filed: Dec. 12, 1997

[51] Int. Cl.[6] ..... B42D 15/00

[52] U.S. Cl. ..... 283/901; 40/306; 40/310; 40/324; 215/6; 215/383; 220/1; 283/81; 283/99; 283/903

[58] Field of Search ..... 40/306, 310, 311, 40/324; 220/1; 283/81, 94, 98, 99, 100, 102, 901, 903; 215/6, 383

[56] References Cited

U.S. PATENT DOCUMENTS

| | | | |
|---|---|---|---|
| Re. 31,702 | 10/1984 | Brown . | |
| D. 302,116 | 7/1989 | Cassai et al. . | |
| 2,420,045 | 5/1947 | Krug | 40/306 |
| 3,422,558 | 1/1969 | Fee | 40/306 |
| 4,015,744 | 4/1977 | Brown . | |
| 4,021,252 | 5/1977 | Banczak et al. . | |
| 4,030,631 | 6/1977 | Brown . | |
| 4,166,044 | 8/1979 | Germonprez et al. . | |
| 4,203,240 | 5/1980 | Goodwin | 40/310 |
| 4,322,016 | 3/1982 | Barrash . | |
| 4,473,962 | 10/1984 | Winston et al. . | |
| 4,551,373 | 11/1985 | Conlon . | |
| 4,559,729 | 12/1985 | White . | |
| 4,726,608 | 2/1988 | Walton | 283/96 |
| 4,872,707 | 10/1989 | deBruin . | |
| 4,911,320 | 3/1990 | Howes . | |
| 5,024,014 | 6/1991 | Swierczek | 40/310 |
| 5,056,659 | 10/1991 | Howes et al. . | |
| 5,056,681 | 10/1991 | Howes . | |
| 5,076,613 | 12/1991 | Kovacs . | |
| 5,215,576 | 6/1993 | Carrick | 524/425 |
| 5,228,692 | 7/1993 | Carrick et al. . | |
| 5,350,612 | 9/1994 | Stern et al. | 428/40.5 |
| 5,451,052 | 9/1995 | Behm et al. | 273/139 |
| 5,524,788 | 6/1996 | Plester . | |
| 5,788,076 | 8/1998 | Simmons | 206/459.5 |

*Primary Examiner*—Willmon Fridie, Jr.
*Assistant Examiner*—Monica Smith
*Attorney, Agent, or Firm*—David W. Brownlee; Edward L. Levine

[57] ABSTRACT

A promotional gaming device for beverage cans which includes ink jet printed indicia of winning status on an exterior surface of the can and an opaque removable material covering the printing. The opaque material may be scratched off or peeled off the reveal the prize indicia.

15 Claims, 3 Drawing Sheets

BEVERAGE CAN HAVING INSTANT WINNER TYPE GAME THEREON

BACKGROUND OF THE INVENTION

1. Field of the Invention

This invention relates to cans for beer and beverages which include promotional games and in particular to cans having promotional prize games or instant winner games on them.

2. Description of the Prior Art

Marketing of consumer products such as foods, beverages, household products and the like is highly competitive, and many millions of dollars are spent annually in advertising and promoting the sale of such products. Most such products are sold in cans, boxes and bottles which are decorated to promote the sale of the products.

Beverages such as beer and soft drinks are sold in cans and bottles, and competition between manufacturers of aluminum, steel, glass and plastic for use in beverage containers is intense due to the many billions of beverage containers that are sold annually. The aluminum beverage can industry would benefit from an increased share of the beverage market by making aluminum cans more interesting and appealing to consumers.

Due to the competitive pressures, games for promoting the sale of products are commonly used. The games induce customers to purchase a particular product because the product includes an opportunity to win a prize or money. One popular retail game device is the "Instant Winner" type in which the customer immediately knows whether he or she is a winner. Such winners can be rewarded at the point of sale or can receive their prize or money by returning the winning gamepieces to a redemption center.

The term "scratch-off games" commonly refers to a promotion, game, lottery, discount coupon, or the like that relies on hidden preprinted data that is revealed by "scratching off" a removable opaque layer. The appeal of such applications is evidenced by the popularity of state lotteries, which have become a major fund raising source in recent years. The "game" can be as simple as revealing a statement of winning or losing status.

The major attribute of existing scratch-off technology is its potential for providing secure preprinted data that is difficult or impossible to reveal prematurely. This technology is most often seen in contexts such as lotteries, product promotions, and discount coupons, as well as financial security instruments or food stamp certificates.

Security of the hidden data has been a primary consideration for the development of the technology behind scratch-off games. The following are nondestructive methods for prematurely reading hidden data which are protected against by current technology:

Candling: this method uses a strong light shown through the front of the ticket.

Delaminating and relaminating.

X-ray technologies.

"Wet pad" techniques: these endeavor to accelerate ink migration by application of a pad wetted with water or another solvent to the rear side of the ticket. When successful, a readable image of the game play data can be transferred to the pad without residual evidence of tampering.

When scratch-off games are printed on paper or cardboard substrates, several security measures are usually combined, such as printing a Benday pattern (usually curved lines that discourage pasting a portion of one ticket into another), printing an optical confusion pattern, and printing thematic graphics over the scratch-off area.

It is desirable for the scratch-off games to be integral with the package for the products in order to avoid handling problems or abuses as can occur if the promotional game is separate from the package. Thus many promotional marketing games involve coupons or tickets which are attached to or contained in packages for the goods being sold.

Soft drink bottlers have used promotional games extensively and have experienced considerable marketing success through the use of the games. Several of the promotional game packages for beverages have been patented. See, for example, U.S. Pat. Nos. 4,911,320; 5,056,659; 5,056,681; and 5,524,788.

Despite the success of existing promotional games for a variety of products including beverage containers, improved systems are desired which are less expensive to manufacture and administer, offer improved security against tampering, and offer greater attractiveness to consumers. It is also desirable to provide a promotional game which increases the interaction between the consumer and the beverage can in order to increase the attractiveness of metal cans and encourage bottlers to package their beverages in cans, and in particular in aluminum cans.

SUMMARY OF THE INVENTION

This invention provides a promotional game for metal cans which is suitable for manufacture by currently employed can-making and decorating plants and existing equipment in a new way which adds little to the cost of manufacturing the cans while providing a very attractive device for promoting the sale of the product. The cans have an indicia of winning status printed on them using conventional ink jet printing equipment and then have the indicia concealed by an opaque material which is applied over the indicia by conventional spray nozzles or peelable tape application equipment. The ink and opaque material can be cured in existing bake ovens at nominal cost.

All of the fraud techniques commonly practiced to defeat scratch-off games are of significantly less concern for games printed on aluminum cans, because of the optically and chemically opaque nature of the aluminum itself. Aluminum cans seem to be an ideal substrate for scratch-off games.

The promotional game device provided by this invention includes a printed indicia of winning status on the exterior surface of the cans such as on the bottom end wall, sidewall or top end closure and has an opaque material overlying the indicia to conceal it until the opaque material is removed as by scratching it off or peeling it off.

An object of this invention is to provide a promotional game for beverage cans which can be manufactured by existing ink jet printers, spray nozzles, bake ovens and the like.

Another object is to provide an attractive promotion game for beverage cans which adds little to the manufacturing cost of the cans.

A further object is to provide a promotional game that has a high degree of security and is simple and convenient to administer.

Another object is to provide a game that increases the interaction between the consumer and aluminum cans and increase the market for such cans as well as increase the market for the beverage in the cans.

The above and other objects and advantages of this invention will be more fully understood and appreciated with reference to the attached drawings and the following description of the invention.

DESCRIPTION OF THE PREFERRED EMBODIMENTS

This invention is especially directed to promotional game systems for cans for soft drinks, beer and other beverages. Many billions of beverage cans are sold every year and promotional games on the cans may greatly increase sales of particular beverages in the cans and also increase the sale of aluminum cans.

Figure 1:
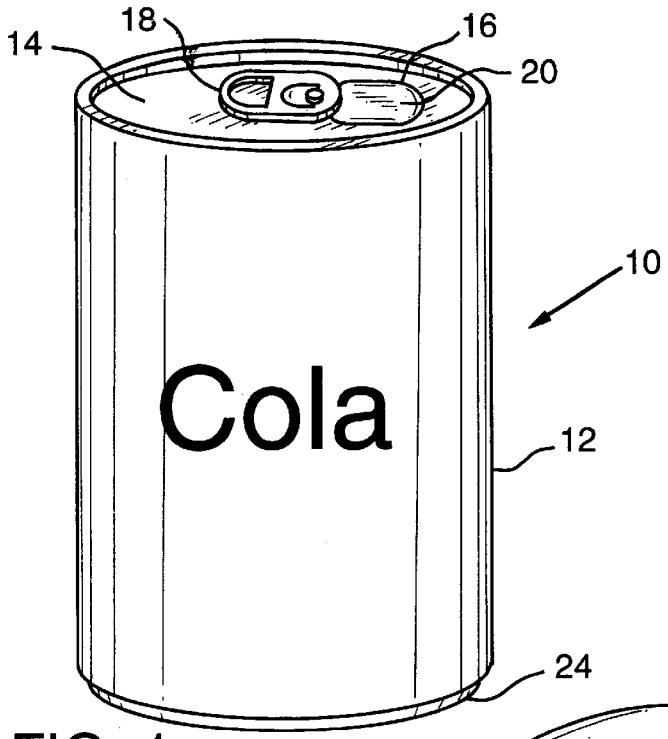
FIG. 1 shows a can for a soft drink beverage on which this invention can be used.

Most beverage cans are made of aluminum or aluminum alloys. The cans comprise a cup shaped can body and an easy opening end closure on the top end. FIG. 1 shows such a can 10 having a can body 12 and an end closure 14 secured on its top as by double seaming a peripheral edge portion of the end closure on the top edge portion of the can body as is well known in the industry. The end closure 14 has a pour opening defined therein by a score line 16 and has a tab 18 which is adapted to be lifted to rupture the score line 16 around the removable panel 20 and depress the panel into the can. Cans of this type are well known in the art as illustrated and described in many patents including U.S. Pat. Nos. 4,015,744; 4,030,631; and Re. 31,702.

It is a feature of this invention that an indicia of winning status is printed on the exterior surface of a beverage can by ink jet printing. Ink jet printing is well known for printing identification information on cans but is not known for printing indicia of winning status on the cans. Ink jet printing is ideal for this invention because of its ability to print continuous variable data, which means it can continuously print non-winners and a variety of winners at speeds commonly used in the manufacture, decoration and filling of beverage cans. An appropriate computer program can randomly print loser/winner data in ratios predetermined for the game. Ink jet printing is also economical and produces a durable and easily readable print on the cans. See for example U.S. Pat. Nos. 4,021,252 and 4,166,044.

Ink jet printing and control equipment suitable for use in this invention is available from several suppliers including Videojet Systems International in Wood Dale, Ill.; Image Ink Jet Printing Corporation in Toms River, N.J.; and Domino Amjet in Gurnee, Ill., among others.

Figure 6:
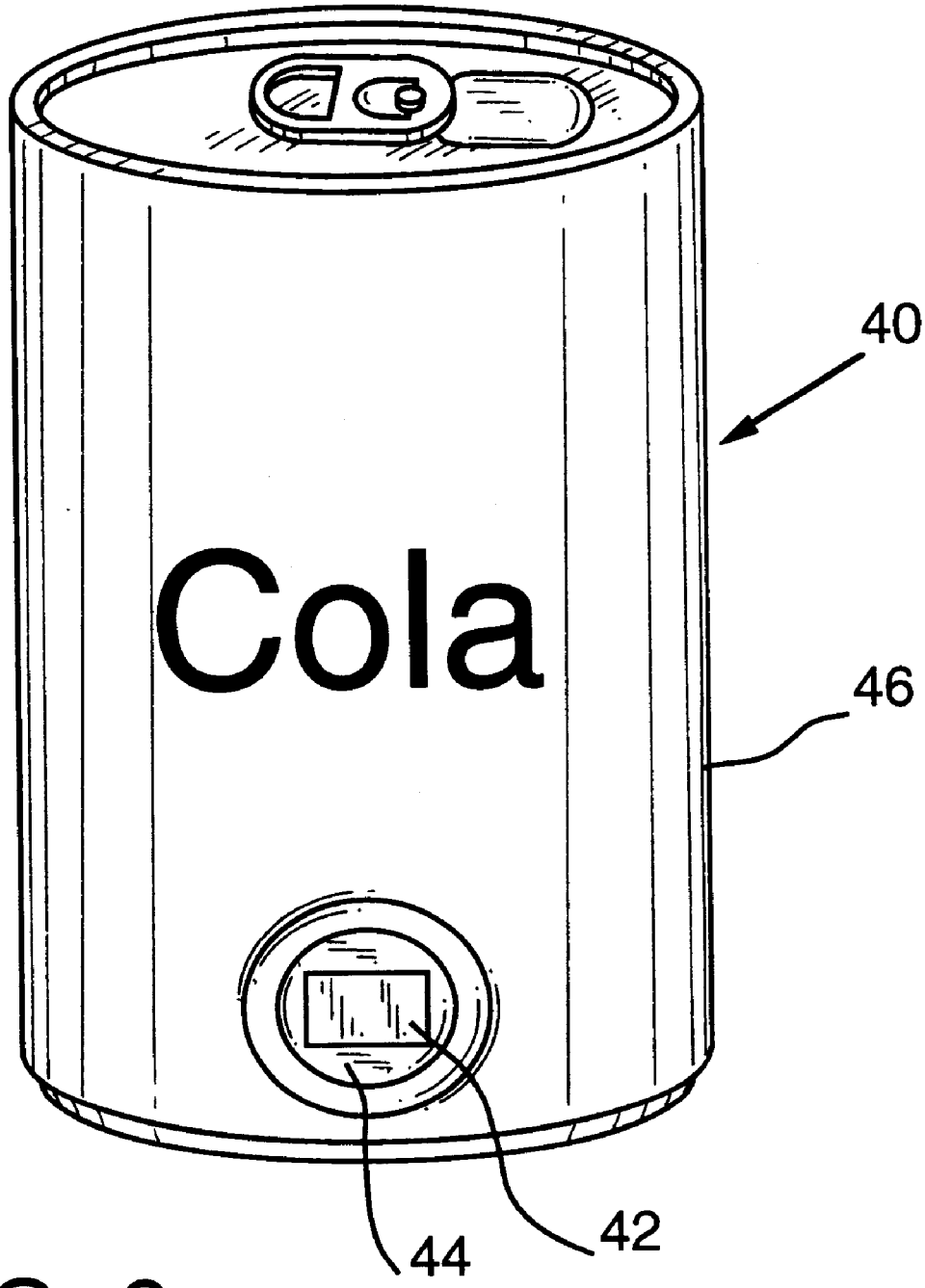
FIG. 6 shows a beverage can having an alternative embodiment of this invention on the sidewall of the can.

The ink jet printing of winning status can be printed at a variety of locations on a beverage can such as on the end closure 14, on the bottom end wall 22 (FIGS. 2, 3 and 4) or on the sidewall of the can body 12 (FIG. 6). The bottom end wall 22 of a typical aluminum beverage can includes a peripheral frustoconical portion 24, which is integrally joined with the sidewall 12, a central recessed domed portion 28 and an annular chime or rim 30 between the recessed portion and frustoconical portion. The recessed dome portion 28 is an excellent site for a promotional game of this invention since it is recessed within and protected by the annular rim 30, and is not generally contacted by mechanical handling equipment or other devices.

Figure 2:
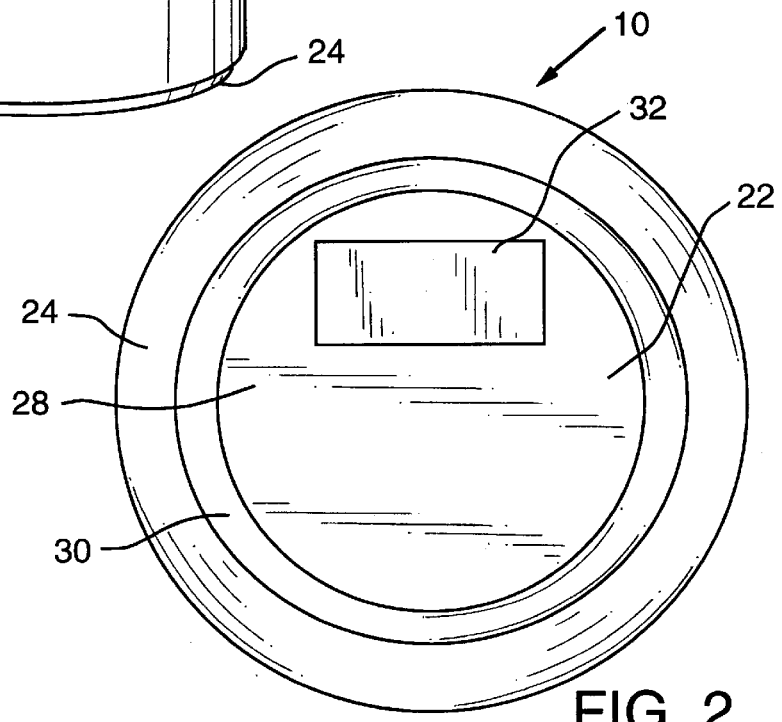
FIG. 2 is a bottom plan view of the can of FIG. 1 having a promotional game system of this invention on the exterior surface of the bottom end wall of the can.
Figure 3:
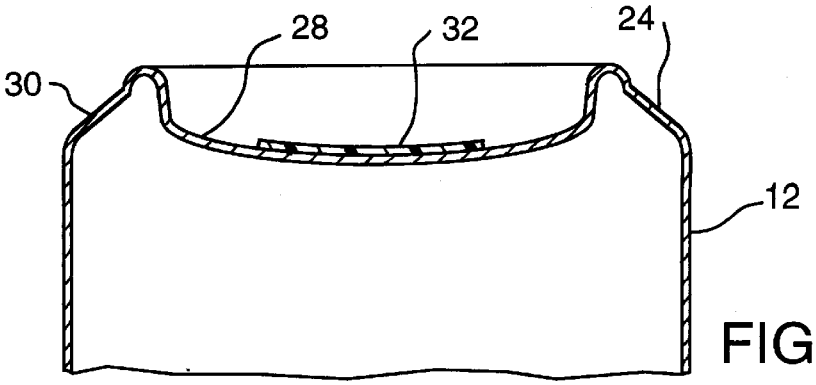
FIG. 3 is a fragmentary cross section through the can of FIG. 2.
Figure 4:
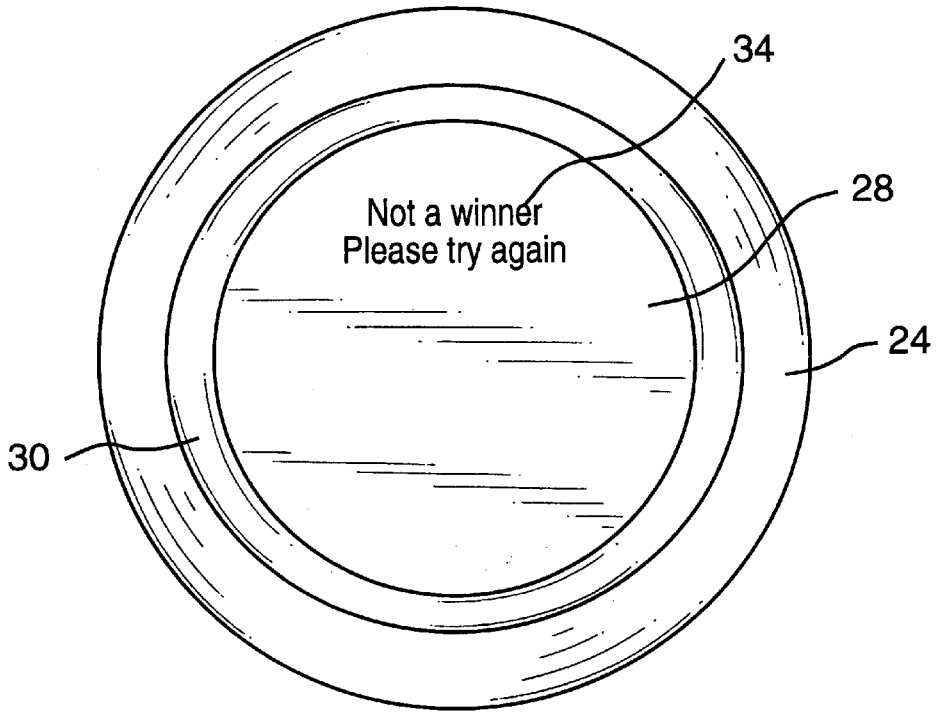
FIG. 4 is a view similar to FIG. 2 and shows the printed indicia of winning status after the opaque covering material has been removed.

FIGS. 2, 3 and 4 show one embodiment of a promotional game on the exterior surface of the recessed dome portion 28 of a beverage can. FIGS. 2 and 3 show the game device with an opaque scratch-off covering material 32 concealing the ink jet printing, and FIG. 4 shows the device with the scratch-off material removed so the printing 34 is visible. The scratch-off coating may include a combination of polymers, fillers and pigments. It is important to select materials which will not wash off or be accidentally removed without being mechanically scratched off the surface of the can. The base material in scratch-off coatings is usually latex or a similar material. Pigments and metal flakes are added for optical and X-ray opacity. Due to the opaque quality of the aluminum can substrate the formulation's security requirements are easier to meet with this invention than in applications that are printed on paper or card stock substrates. The potential benefits of this are reduced cost and greater application latitude. Applying a scratch-off coating to the dome may be performed by techniques such as spray application, a convex pad application or possibly ink jet equipment. Scratch-off coatings may be applied to can sidewalls 12 or frusto-conical portion 24 by screen printing, gravure, or flexography. Peelable tapes can be used as an alternative to scratch-off coatings, but are not preferred. Tapes suitable for such purpose are known in the art as described in U.S. Pat. No. 5,228,692, the disclosure of which is incorporated herein by reference. As disclosed in that patent, the peelable tape may comprise metal foil or opaque paper, which has a peelable adhesive for securement over the prize indicia. The peelable tape may have a tab which is not adhered to the can so the consumer can grip the tab to remove the tape.

FIG. 4 shows the bottom end wall of the can 10 after the opaque covering material has been removed to expose the printed indicia 34 of winning (or non-winning) status. Depending on the game, the indicia may be a dollar amount, letter, word, number or other indicia which either indicates an instant winner or may require combination with indicia on other cans to produce a winner.

Figure 5:
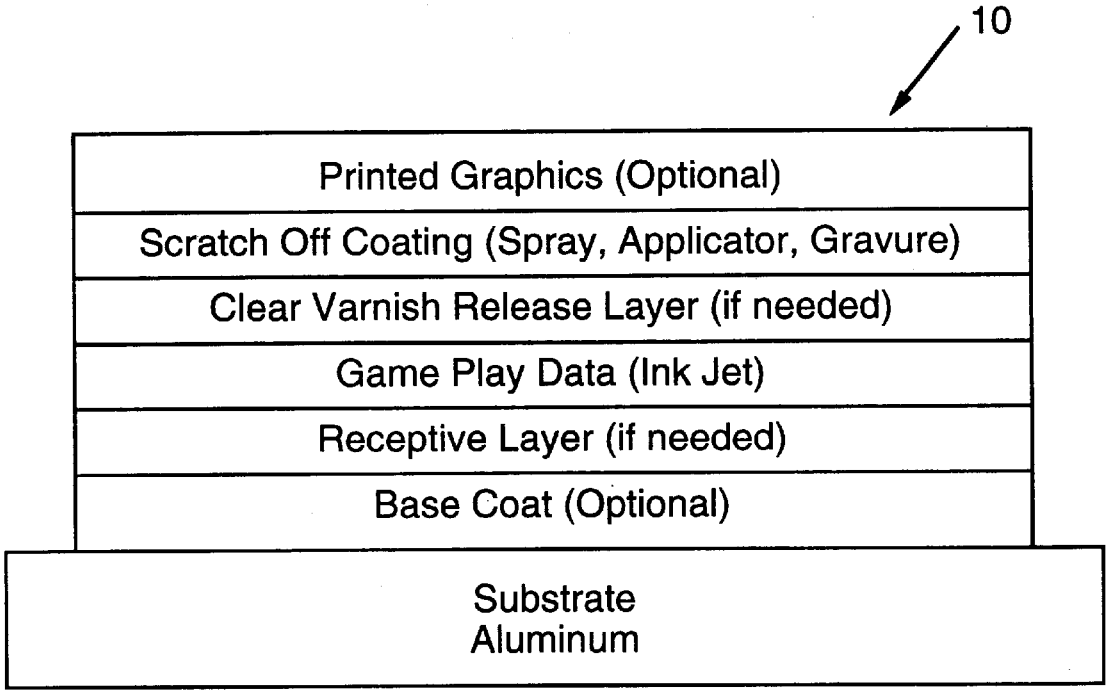
FIG. 5 is a diagram of the composite structure of a preferred embodiment of a scratch-off game on an aluminum can.

FIG. 5 is a representation of the composite makeup of a cross-section through a gaming device on an aluminum can 10. The aluminum substrate may be in the bottom end wall, sidewall or top end closure of the can which may optionally have a conventional base coating of varnish, or lacquer, or other protective coating on it. A layer of receptive material for improving adherence of the ink jet printing may be optionally applied over the base coat or on the bare metal if no base coat is used.

The game play data is next printed on the can by ink jet printing. This can be done at high speeds using a computer that is programmed to randomly print loser/winner data on the cans at speeds of about 2000 cans per minute or higher. A clear varnish release layer may be applied, if needed, over the ink jet printing, and an opaque scratch-off coating is applied over the release coating, if used, or over the ink jet printing if a release coating is not required. The scratch-off coating may be applied by spray, applicator or gravure. Printed graphics may also optionally be applied over and/or adjacent to the game data to provide instructions or decoration for the game and the can.

FIG. 6 shows an alternative embodiment of aluminum can 40 having a promotional game 42 in a recessed area 44 in the can sidewall 46. The recessed area is shown as being round but may have other shapes such as rectangular or elliptical. The can is preferably a drawn and ironed aluminum can. The recessed area may be embossed in the sidewall 46 after the can body has been drawn and ironed. The game 42 in the recessed area 44 would preferably have a composite structure as shown in FIG. 5.

It is therefore seen that this invention provides a promotion game device for beverage cans which is inexpensive to manufacture, secure against tampering and simple to administer while being attractive to consumers. It will be apparent to those skilled in the art that numerous modifications may be made to the invention without departing from the spirit of the invention or the scope of the claims appended hereto.

We claim:

1. In a metal can, the improvement of a promotional game device on the can comprising ink jet printed indicia of winning status on an exterior surface of the can and opaque covering material over the printed indicia, said opaque covering material being removable to expose the printed indicia, and said can has a recessed area in said exterior surface and said promotional game device is on the exterior surface within said recessed area.

2. A metal can as set forth in claim 1 in which said opaque covering material comprises a scratch-off, wax-like coating that conceals said printed indicia until the coating is scratched off to expose said printed indicia.

3. A metal can as set forth in claim 1 in which said opaque covering material comprises a peelable strip that conceals said printed indicia until the strip is peeled off to expose said printed indicia.

4. A metal can as set forth in claim 1 which has a bottom end wall and said printed indicia is on said bottom end wall.

5. A metal can as set forth in claim 1 which has a cylindrical sidewall and said indicia is on a recessed portion of said sidewall.

6. An easy opening can as set forth in claim 1 which has a top end closure and said printed indicia is on said top end closure.

7. A metal can as set forth in claim 1 that is an easy opening aluminum can.

8. A metal can as set forth in claim 1 that has a release coating over ink jet printed indicia of winning status.

9. A method for manufacturing metal cans having a promotional game on the cans comprising providing a metal can, ink jet printing indicia of winning status on an exterior surface of said can within a recessed area in said exterior surface, and covering said printed indicia with a removable opaque material which conceals said indicia until said opaque material is removed from over said indicia.

10. A method as set forth in claim 9 in which said removable opaque material is a scratch-off, wax-like coating that conceals said printed indicia until the coating is scratched off said can to reveal said printed indicia.

11. A method as set forth in claim 9 in which said removable opaque material comprises a peelable strip.

12. A method as set forth in claim 11 in which said printed indicia is printed on a bottom end wall of said can.

13. A metal can as set forth in claim 1 that is an easy opening beer or beverage can.

14. A metal can as set forth in claim 1 that is a steel can.

15. A method as set forth in claim 9 in which said can has a top end closure and said indicia is printed on the top end closure.

* * * * *